United States Patent [19]

Edwards

[11] 4,329,063

[45] May 11, 1982

[54] FOUNDRY SAND MIXING MACHINE

[75] Inventor: Albert Edwards, Bourne, England

[73] Assignee: Baker Perkins Holdings Ltd., England

[21] Appl. No.: 97,617

[22] Filed: Nov. 27, 1979

Related U.S. Application Data

[63] Continuation of Ser. No. 894,724, Apr. 10, 1978, Pat. No. 4,175,866, which is a continuation-in-part of Ser. No. 724,670, Nov. 17, 1976, abandoned.

[30] Foreign Application Priority Data

Nov. 26, 1975 [GB] United Kingdom ..... 48553/75

[51] Int. Cl.[3] ..... B28C 5/00; B01F 15/00

[52] U.S. Cl. ..... 366/34; 366/40; 366/64; 366/172; 366/173

[58] Field of Search ..... 366/34, 40, 64, 66, 366/65, 138, 144, 2, 3, 4, 10, 13, 167, 168, 6, 7, 172, 173; 134/348, 65, 132, 104, 145

[56] References Cited

U.S. PATENT DOCUMENTS

| | | | |
|---|---|---|---|
| 2,709,075 | 5/1955 | August | 366/40 |
| 2,861,787 | 11/1958 | Csanyi | 366/66 |
| 3,067,987 | 12/1962 | Ballou | 366/161 |
| 3,128,997 | 4/1964 | Young | 366/64 |
| 3,134,579 | 5/1964 | Booth | 366/34 |
| 3,138,167 | 6/1964 | Fisher | 134/145 |
| 3,248,092 | 4/1966 | Atkins | 366/301 |
| 3,387,829 | 6/1968 | Nangoh | 366/64 |
| 3,580,422 | 5/1971 | Hartley | 222/57 |
| 3,729,177 | 4/1973 | Keyes | 134/132 |
| 3,822,737 | 7/1974 | Edwards | 366/182 |
| 3,943,991 | 3/1976 | Edwards | 164/191 |

FOREIGN PATENT DOCUMENTS

| | | |
|---|---|---|
| 411192 | 2/1968 | Australia . |
| 44610 | 4/1970 | Australia . |
| 485420 | 8/1977 | Australia . |
| 874266 | 4/1953 | Fed. Rep. of Germany . |
| 1041065 | 10/1958 | Fed. Rep. of Germany . |
| 1043183 | 11/1958 | Fed. Rep. of Germany . |
| 1194533 | 6/1965 | Fed. Rep. of Germany . |
| 1901858 | 1/1969 | Fed. Rep. of Germany . |
| 2240035 | 8/1972 | Fed. Rep. of Germany . |
| 2335262 | 7/1973 | Fed. Rep. of Germany . |
| 1383494 | 11/1964 | France . |
| 1432145 | 2/1966 | France . |
| 2224284 | 10/1974 | France . |
| 79367 | 12/1975 | German Democratic Rep. . |
| 48-41247 | 12/1973 | Japan . |
| 49-58459 | 6/1974 | Japan . |
| 854273 | 11/1960 | United Kingdom . |
| 961410 | 6/1964 | United Kingdom . |
| 1020106 | 2/1966 | United Kingdom . |
| 1038789 | 8/1966 | United Kingdom . |
| 1111953 | 5/1968 | United Kingdom . |
| 1115282 | 5/1968 | United Kingdom . |
| 1165551 | 10/1969 | United Kingdom . |
| 1286959 | 8/1972 | United Kingdom . |
| 1300092 | 12/1972 | United Kingdom . |
| 1300093 | 12/1972 | United Kingdom . |
| 1407035 | 9/1973 | United Kingdom . |
| 1334715 | 10/1973 | United Kingdom . |
| 1334716 | 10/1973 | United Kingdom . |
| 1369269 | 10/1974 | United Kingdom . |
| 1369445 | 10/1974 | United Kingdom . |
| 1369446 | 10/1974 | United Kingdom . |
| 1418491 | 12/1975 | United Kingdom . |

OTHER PUBLICATIONS

Article in "Precast Concrete", pp. 212 and 213, Apr. 1973.

*Primary Examiner*—Robert W. Jenkins
*Attorney, Agent, or Firm*—Learman & McCulloch

[57] ABSTRACT

An apparatus for inhibiting the gross build up of a cold setting foundry sand mixture in a mixing machine in which a fluid inhibitor is discharged into the machine while the machine is substantially empty to prevent or retard the setting of the foundry sand mixture.

12 Claims, 2 Drawing Figures

FOUNDRY SAND MIXING MACHINE

This application is a continuation of application Ser. No. 894,724, filed Apr. 10, 1978, now U.S. Pat. No. 4,175,866 which is a continuation-in-part of application Ser. No. 724,670, filed Nov. 17, 1976, now abandoned.

BACKGROUND OF THE INVENTION

This invention relates to a method of inhibiting the gross buildup of a cold setting foundry sand mixture upon elements of a mixing machine exposed to the mixture during the process of mixing the mixture, in particular when the mixture has a tendency to adhere to the elements and to set thereupon at ambient temperature to build up a coating on the elements. The invention has particular application to the manufacture of sand-based foundry moulds or cores of the cold-setting type. The normal foundry sand mixture contains sand and a binder; the binder may be a resin and an additional substance such as a catalyst or a resin component can be incorporated in the mixture itself to cause the resin to set. One well-known foundry sand mixture contains a furfural or a urea resin, which is caused to set by an acid catalyst or hardener; a further acid-hardening resin is a phenolic resin. An example of another type of resin is a polyurethane resin, which is normally hardened by the addition of a diisocyanate, which is somewhat alkaline.

The normal foundry sand mixtures are tacky, usually because of the resin precursor in the mixture, and the mixture adheres to every part of the interior of the mixing machine.

The invention particularly relates to mixing machines in which at least one moveable mixing element passes close to the walls of the mixing machine and moves at a sufficiently high speed for centrifugal force to prevent gross build-up of the mixture on the moveable element. In one particular mixing machine of this type, the mixing element rotates at a speed of about 500 r.p.m., and there is a clearance of about $\frac{1}{8}$ inch between the periphery of the mixing element and the internal walls of the mixing machine. The mixing machine may have a main trough 6 feet long and of about 6 inches diameter.

If nothing is done about the adherence of the mixture to the interior of the mixing machine, the adhered layer sets during the course of mixing a number of batches. Only a thin layer initially remains on the mixing element because centrifugal force throws off any larger lumps of material, but once the thin layer has set, a further thin layer can adhere and in turn set, leading to gross build-up of hardened material on the mixing element. In the case of the walls of the mixing machine, the mixing element prevents any initial build-up greater than the clearance between the mixing element and the walls; however, as the mixture sets, it initially shrinks, allowing slight further build-up, and then it warms up and expands, such expansion being required for good formation of the moulds; due to this expansion, the mixing element fouls the material and the mixing machine bangs and shakes, causing extreme wear of the mixing element. In addition to the unacceptable banging and shaking and extreme wear, the actual efficiency of the mixing machine is reduced, particularly due to the build-up on the mixing element, and furthermore set material breaks off and can be incorporated in the foundry mould or core and later require the mould or core to be scrapped.

In general, the only way of cleaning the mixing machine was to withdraw the mixing element and chip off all the set material, which was done in normal practice at least twice a day. This causes great loss of machine time. An alternative method of cleaning the machine was to remove the adhered mixture before it had set using high pressure air jets, but I believe that this was always done using a lance held in the hand, and this cleaning procedure took a significant amount of time and was thus relatively expensive.

In a different field, that of mixing foodstuffs, U.S. Pat. No. 3,138,167 discloses a mixing machine in which pressure gas or liquid is directed to all parts of the interior of the mixing machine after mixing each batch, in order to remove every trace of the previous batch. However, this also can be time-consuming and I have discovered that such a procedure is not necessary to avoid the problems given in mixing cold-setting foundry sand mixtures.

OUTLINE OF THE INVENTION

According to my invention, a fluid inhibitor is first discharged onto the said elements of the mixing machine, the inhibitor being operable to prevent or retard the setting of the foundry sand mixture, and the foundry sand mixture is subsequently introduced into the mixing machine for the mixing operation.

Using the invention, the fluid inhibitor prevents or retards the setting of that portion of the foundry sand mixture which adheres to the said elements, and leaves the said elements substantially covered with a layer of the foundry sand mixture which, at least initially, is not fully set. It will be seen therefore that the invention, unlike the Fisher Patent referred to above, does not set out to remove all the foundry sand mixture from the interior of the mixer.

The preferred fluid inhibitor is a liquid inhibitor, preferably comprising water and small proportions of a substance which prevents or retards the setting of the foundry sand mixture and of a detergent. It is believed that when the liquid inhibitor is used, a layer having a thickness equal to the clearance between the mixing element and the internal walls of the mixing machine, builds up on the internal walls and a layer of uneven thickness builds up on the mixing element itself though large accumulations are thrown off by centrifugal force. However, because of the presence of the liquid inhibitor, which is spread into the foundry sand mixture to a certain extent, the layer does not harden and remains somewhat soft, having the consistency of a hard cheese. For cleaning, this layer can be scraped off without any difficulty, and furthermore, the layer prevents further build up on the mixing element as it does not provide a solid surface for the adherence of further foundry sand mixture.

In general, the inhibitor can be applied to the interior of the mixing machine on start-up, when the mixing machine may be clean, and also between batches, when the interior of the mixing machine will be covered with a layer of not properly set foundry sand mixture; the application of the inhibitor thus prevents or retards further setting of the layer already present and also prevents or retards setting of further foundry sand mixture which comes in contact with the layer already present. Nonetheless, the main bulk of the foundry sand mixture being mixed in the mixer will not have the inhibitor applied thereto and will not lose its tendency to set, so that the foundry mould will have effectively the same setting time as previously.

For an acid-setting resin, ammonia is a cheap and effective substance for preventing or retarding the setting of the foundry sand mixture, although other alkaline materials could be used, such as sodium hydroxide. In the case of the diisocyanate-hardened polyurethane resin, a suitable non-alkaline inhibitor can be used. In all these cases, the inhibitor chemically prevents the catalysing effect of the catalyst or prevents the crosslinking effect of a resin component.

The addition of a detergent improves the performance of the liquid inhibitor, and improved performance can also be obtained if the liquid inhibitor acts as a lubricant, i.e. is specifically of a lubricating nature.

Another possibility is to use a gaseous inhibitor in the form of a gas applied under pressure to the said elements of the mixing machine, to cool the elements.

The action of the gas is not well understood, but it is believed that the gas cools the elements to below 45°-50° F. and thereby increases the setting time (to for instance about 30 minutes for a urea resin instead of about 30 seconds at the optimum setting temperature of 60° F.). Thus much of the foundry sand mixture is thrown off the mixing element before the mixture has time to set; on the internal walls of the mixing machine, the foundry sand mixture expands gradually as setting slowly proceeds and the partly set and not properly hardened mixture is scraped off little by little by the mixing element in the form of fine sand, avoiding the banging and shaking referred to above. In this case, the foundry sand mixture which remains on the interior walls and on the mixing element will eventually set hard, but the presence of the foundry sand mixture does not matter as it will not interfere with the running of the machine.

The range of possible gases has not been fully investigated, but it is found that carbon dioxide works, even for acid-setting resins, and that nitrogen works, though less effectively. It is believed that any gas compatible with the foundry sand mixture would work, provided the cooling effect is marked, and the use of compressed air is envisaged as a practical alternative to the use of carbon dioxide.

DETAILED DESCRIPTION OF ONE EMBODIMENT OF THE INVENTION

Figure 1:
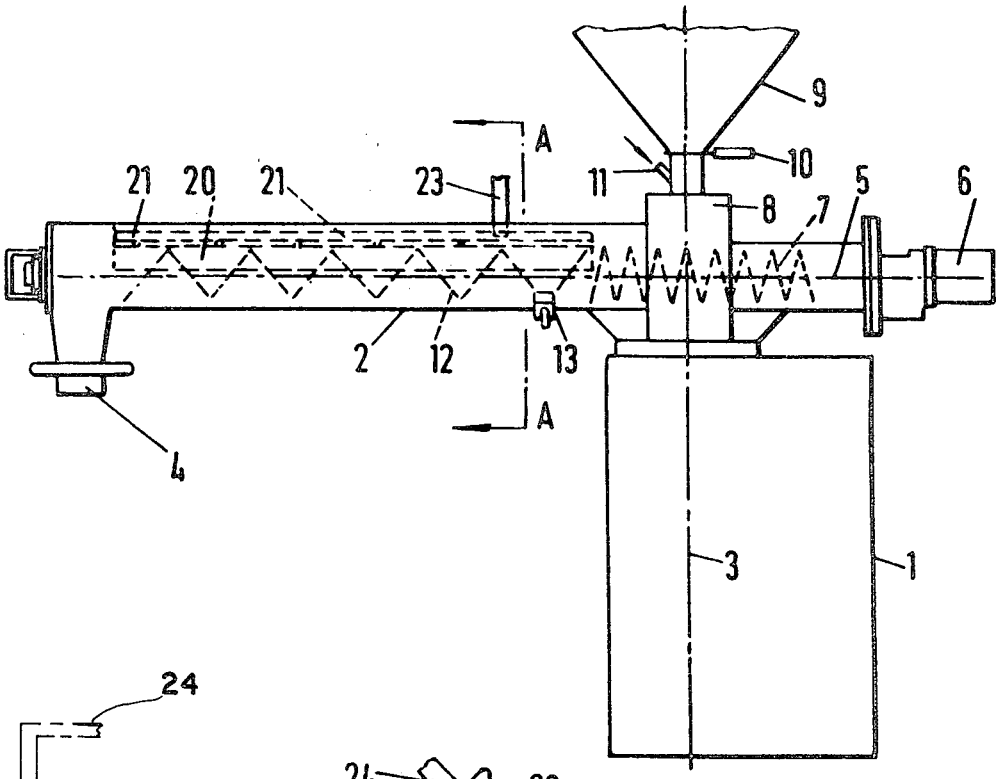
FIG. 1 is a diagramatic side-view of an embodiment of a mixing machine to which the method of the invention can be applied.
Figure 2:
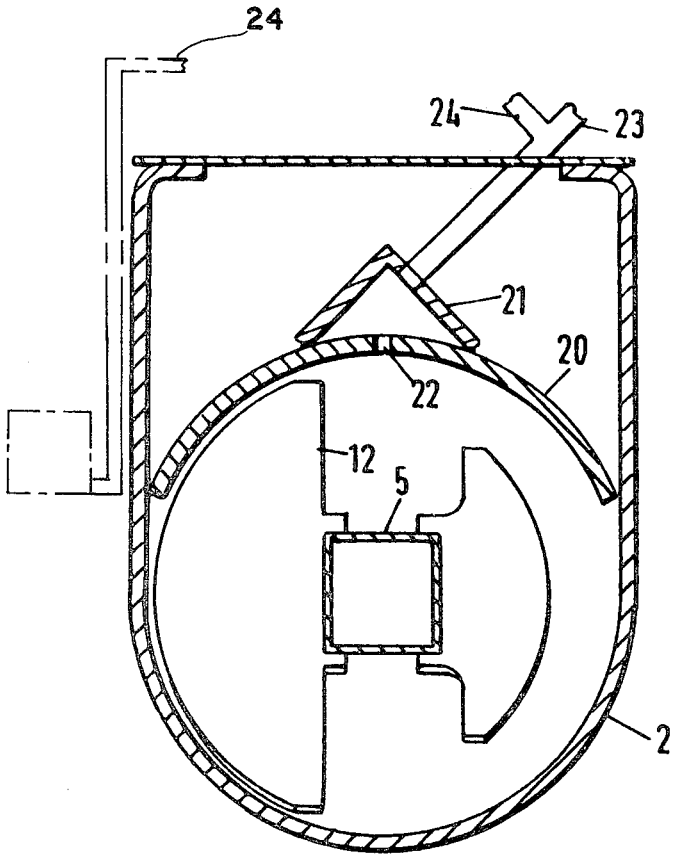
FIG. 2 is an enlarged cross-sectional view of the mixing trough of the machine, taken along the line A—A in FIG. 1.

The mixing machine shown in FIG. 1 comprises a stand 1 and a mixing trough 2 supported on the stand 1 for rotation about an axis 3. Such an arrangement permits displacement of the outlet 4 of the trough between positions above several mould or core boxes arranged on an arc. As is known with continuous mixers for cold setting mixtures, further articulations may be provided to allow the outlet 4 to be positioned as described.

The trough 2 accommodates a shaft 5 driven in rotation by a motor 6. A screw mixing element 7 is arranged on the shaft 5 at one end of the trough 2. An inlet 8 above the element 7 admits sand and catalyst (acid) to the trough, the sand being supplied from a hopper 9 via a gate valve 10, and the acid being fed through an inlet pipe 11. The screw element 7 simultaneously mixes the sand and catalyst and conveys the mixture along the trough 2.

A further mixing element 12, designed to subject the mixture to a backward and forward conveying action, as described in U.S. Pat. No. 3,248,092 is arranged on the shaft 5 downstream of the element 7. An inlet 13 is arranged near the interface between the elements 7 and 12 for injecting atomised binder (resin) into the sand-/catalyst mixture in trough 2, and the final sand-/catalyst/binder mixture is thoroughly mixed by the element 12 and conveyed to the outlet 4.

A plate 20 is arranged along the trough 2 above the element 12 which mixes the final mixture, and is of part-circular cross-section to cooperate with the U-sectioned trough to enclose the element 12. A manifold 21 is positioned above the plate 20 and communicates with the trough 2 through holes 22 provided along the plate 20, the holes being of ⅛th of an inch diameter at 2 in. spacing of centres.

An inhibitor is fed into the manifold under the effect of pressurized air from a pipe 23, the inhibitor being supplied from a branch pipe 24. All the interior parts of the mixing machine were covered with fine droplets, and, if a detergent was added, the droplets joined together, leaving a thin film of liquid over all the interior parts of the mixing machine; in addition, it was found that the detergent improved the atomization at the holes 22.

As an example with resin as a binder and acid as a catalyst, the inhibitor may comprise by weight 3% ammonia, 2% liquid detergent known under the Trade Mark "Teepol", and 95% water. The air pressure in the pipe 23 may for example be 80 p.s.i., and the result is a fine mist of the inhibitor being fed from the manifold 21 into the mixing trough 2. Using the specific liquid inhibitor noted above, the outlet end of the mixing machine need be cleared daily and the whole mixing machine need only be cleared weekly. It was also found that if the detergent was omitted, the mixing machine could be run for 15–20 batches or even for 30 batches without banging or seizing up. Below 3% by weight of ammonia, the method of the invention still had beneficial effects, but the length of time that the machine ran without banging and seizing up was very markedly reduced.

In practice, when the machine is to be started up for mixing, a pre-wetting operation is first carried out, the trough 2 and element 12 being sprayed with inhibitor. After the mixing cycle is completed, the length of the cycle depending on the size of the mould or core to be manufactured, feed of sand, acid and resin is stopped and inhibitor is sprayed from the manifold 21 for approximately 20 seconds. The operation of spraying the inhibitor can be controlled automatically and linked in the mixing cycle with an additional control to introduce the spray as and when necessary, for example at the end of a working shift.

Using the arrangement described above, it has been found that whilst the inhibitor does not maintain a thoroughly clean mixing machine, only a soft thin layer of sand mixture adheres to the wall of the mixing trough, which can readily be removed during machine servicing. Furthermore, the small quantities of alkali introduced into the trough have no detrimental effect on the quality of the finished moulds and cores.

As an alternative to the use of the liquid inhibitor described above, a gaseous inhibitor in the form of a pressurized gas can be blown in through the same holes 22 prior to mixing, and between mixing, batches of a urea resin (acid catalyst) foundry sand mixture. In one example, carbon dioxide was blown in at 25 p.s.i. for 1 minute. The mixing machine ran without banging or seizing up and without delivering hardened lumps of mixture at the outlet end. There was a build-up of hardened mixture on the walls of the trough 2, but this was not deleterious for reasons explained above. There was also a gradual build-up of hardened mixture on the mixing element 12.

I claim:

1. In a self emptying foundry sand mixer for mixing cold-setting foundry sand mixtures which have a tendency to adhere to and set upon parts within the mixer and thereby form a hardened coating on such parts, the mixer comprising:

a. an axially extending mixing chamber defining substantially circular section internal wall surfaces;

b. mixing element means rotatably mounted in the mixing chamber for rotation about at least one axis coaxial with such internal wall surfaces, the mixing element means having radially outer surfaces which are spaced from but close to said internal wall surfaces and which extend substantially along the whole axial length of the mixing chamber when at rest whereby revolution of the mixing element means will cause it to sweep substantially the whole axial length of said internal wall surfaces;

c. means for supplying sand and binder means to one end of the mixing chamber;

d. means defining an outlet for discharging a foundry sand mixture comprising said sand and binder means from the other end of the mixing chamber; and e. drive means for rotating the mixing element means to move the foundry sand mixture from the supply end of the mixing chamber to the outlet in successive cycles;

the improvement wherein:

f. mixture set-inhibiting means is included for providing a liquid inhibitor, operable to prevent or retard the setting of the mixture on said surfaces and mixing element means between the mixing of successive mixes to maintain the residual mixture in the mixer soft; the means including openings along the mixing chamber leading to the interior of the mixing chamber for dispersing the inhibitor over said wall surface and mixing element means, and a liquid inhibitor supply source connected with said openings.

2. A mixing machine as claimed in claim 1 wherein the supply source includes a manifold arranged exteriorly of the mixing chamber coextensively with said openings to communicate with said openings and spray the said internal wall surfaces as well as the mixing element means.

3. A mixing machine as claimed in claim 2, wherein the manifold is provided with an inlet pipe connectible to a source of pressurized air and carrying a branch pipe connectible to a source of inhibitor.

4. The mixer of claim 1 wherein automatic control means are provided for causing the fluid inhibitor to be discharged through said openings after each mixing cycle when the mixture has been substantially discharged from the mixer.

5. The mixer of claim 1 wherein said supply source includes a manifold connected with said openings, a liquid inhibitor supply conduit connected to the manifold, and a compressed air supply conduit connected to the manifold.

6. The mixer of claim 5 wherein said supply source comprises a manifold connected to said openings, and a single supply conduit connected to the manifold to which single supply conduit is connected said liquid inhibitor supply conduit and said compressed air supply conduit.

7. The mixer of claim 1 wherein said supply source comprises a container containing liquid inhibitor, the container being connected to the openings for passing liquid inhibitor thereto.

8. The mixer of claim 7 for use with a sand/resin/acid foundry sand mixture, the container containing an alkaline water-based solution.

9. The mixer of claim 8 wherein the solution includes ammonia.

10. The mixer of claim 7 wherein the container contains a liquid comprising water and a small proportion of a detergent.

11. The mixer of claim 1, and being of the type having a single, horizontal-axis mixing chamber which comprises a pre-mix section in which the binder means are added and the mixing chamber proper in which all ingredients are mixed together, said openings being spaced along the mixing chamber proper.

12. In a self emptying foundry sand mixer for mixing cold-setting foundry sand mixtures which have a tendency to adhere to and set upon parts within the mixer and thereby form a hardened coating on such parts; the mixer comprising:

a. an axially extending mixing chamber defining substantially circular section internal wall surfaces;

b. mixing element means rotatably mounted in the mixing chamber for rotation about at least one axis coaxial with such internal wall surfaces, the mixing element means having radially outer surfaces which are spaced from but close to said internal wall surfaces and which extend substantially along the whole axial length of the mixing chamber when at rest whereby revolution of the mixing element means will cause it to sweep substantially the whole axial length of said internal wall surfaces;

c. means for supplying sand and binder means to one end of the mixing chamber;

d. means defining an outlet for discharging a foundry sand mixture comprising said sand and binder means from the other end of the mixing chamber; and e. drive means for rotating the mixing element means to move the foundry sand mixture from the supply end of the mixing chamber to the outlet in successive cycles;

the improvement wherein:

f. mixture set-inhibiting means is included for providing a liquid inhibitor, operable to prevent or retard the setting of the mixture on said surfaces and mixing element means between the mixing of successive mixes to maintain the residual mixture in the mixer soft; the means including a layer, which includes said inhibitor, coating said surfaces and mixing element means, and openings along the mixing chamber leading to the interior of the mixing chamber for dispersing the inhibitor over said wall surface and mixing element means, and a liquid inhibitor supply source connected with said openings.

* * * * *